US005333997A

United States Patent [19]

Hormann et al.

[11] Patent Number: 5,333,997

[45] Date of Patent: Aug. 2, 1994

[54] DEVICE FOR THE POWER CONTROL OF AT LEAST TWO HYDROSTATIC VARIABLE DISPLACEMENT PUMPS

[75] Inventors: Werner Hormann, Illertissen; Manfred Blum, Weissenhorn, both of Fed. Rep. of Germany

[73] Assignee: Hydromatik GmbH, Elchingen, Fed. Rep. of Germany

[21] Appl. No.: 25,625

[22] Filed: Mar. 2, 1993

[30] Foreign Application Priority Data

Mar. 19, 1992 [DE] Fed. Rep. of Germany ..... 4208925

[51] Int. Cl.[5] ..... F04B 49/08

[52] U.S. Cl. ..... 417/216; 60/428

[58] Field of Search ..... 417/216, 218; 60/428, 60/430

[56] References Cited

U.S. PATENT DOCUMENTS

| | | | |
|---|---|---|---|
| 4,123,202 | 10/1978 | James et al. | 417/216 |
| 4,495,766 | 1/1985 | Krusche | 60/428 |
| 4,528,814 | 7/1985 | Stumr | 60/428 |
| 4,531,367 | 7/1985 | Backe et al. | 417/216 |
| 4,745,747 | 5/1988 | Krausse et al. | 60/452 |
| 4,813,235 | 3/1989 | Miller | 60/452 |
| 4,949,541 | 8/1990 | de Vietro | 6/413 |
| 5,226,289 | 7/1993 | Krebs | 60/430 |

FOREIGN PATENT DOCUMENTS

| | | |
|---|---|---|
| 1922269 | 11/1970 | Fed. Rep. of Germany . |
| 3728207 | 3/1989 | Fed. Rep. of Germany . |
| 3919175 | 12/1990 | Fed. Rep. of Germany . |

*Primary Examiner*—Louis J. Casaregola

*Assistant Examiner*—Peter Korytnyk

*Attorney, Agent, or Firm*—Scully, Scott, Murphy & Presser

[57] ABSTRACT

The invention relates to a power control device for two variable displacement pumps, each with an adjusting device which can be acted upon by adjusting pressure, a power control valve associated therewith, which is acted upon by a first control pressure corresponding with the operating pressure of the variable displacement pump to be adjusted against a pressure difference in the direction of the control position, in which the adjusting pressure loading is controlled in the direction of reduced displacement of the variable displacement pumps along a hyperbolic control curve, whereby the pressure difference results from a spring-arrangement backpressure counteracting the first control pressure and a second control pressure corresponding with the operating pressure of the other variable displacement pump and with increase of the same drops from a maximum value to a minimum value. In order to set the latter value with the device, it is provided in accordance with the invention that the spring arrangement comprises a first and a second pressure spring, the first pressure spring is set to a force corresponding with the minimum value ($\Delta p_{min}$) and the second pressure spring is set to a force corresponding with the difference ($\Delta p_{max} - \Delta p_{min}$) between maximum value ($\Delta p_{max}$) and minimum value ($\Delta p_{min}$) of the pressure difference, and the first pressure spring with its setting force and the second pressure spring with a force decreasing with increasing second control pressure act upon the power control valve.

3 Claims, 1 Drawing Sheet

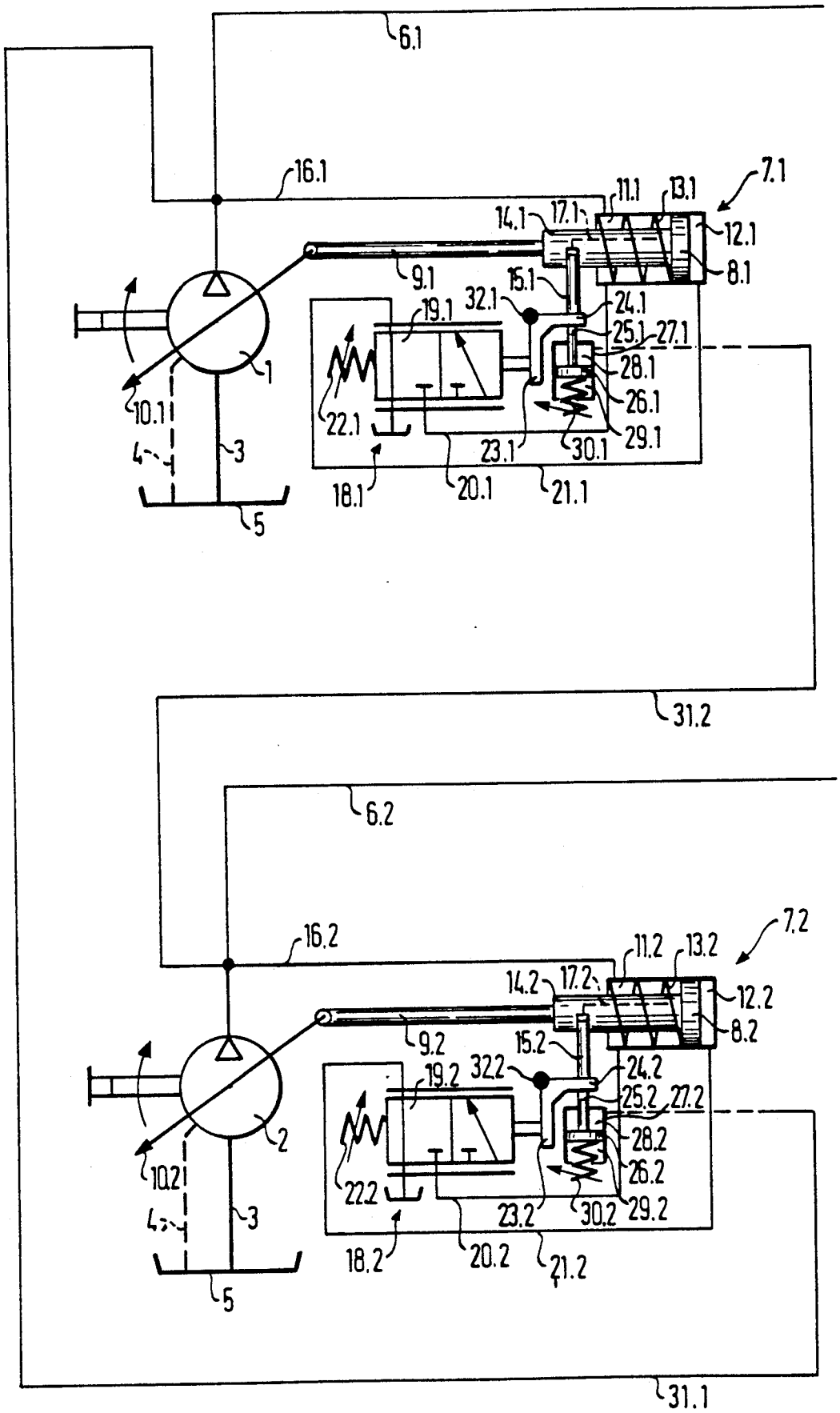
6.1
16.1
7.1
11.1
13.1
14.1
17.1
12.1
8.1
9.1
15.1
32.1
24.1
19.1
25.1
27.1
28.1
26.1
29.1
1
10.1
22.1
4
3
23.1
30.1
18.1
20.1
21.1
5
31.2
6.2
16.2
7.2
11.2
13.2
14.2
17.2
12.2
8.2
9.2
15.2
32.2
24.2
19.2
25.2
27.2
28.2
26.2
29.2
2
10.2
22.2
4
3
23.2
30.2
18.2
20.2
21.2
5
31.1

DEVICE FOR THE POWER CONTROL OF AT LEAST TWO HYDROSTATIC VARIABLE DISPLACEMENT PUMPS

TECHNICAL FIELD AND PRIOR ART

The invention relates to a device for the power control of at least two hydrostatic variable displacement pumps.

BACKGROUND OF THE INVENTION AND PRIOR ART

Devices of this kind are known in practice and are represented, for example, on page 9 of the technical supplement RD93010/03.87 of the firm Hydromatik GmbH under the title Cross-Sensing. The power control of this known device is a summation power control which distributes the total drive power made available by the drive motor in a manner between the two variable displacement pumps in a demand oriented manner. Like every power control it is based on the principle of adjusting the displacement of the variable displacement pumps in dependence upon the first control pressure along a hyperbolically extending characteristic curve, so that the maximum drive torque or, with constant drive speed, the maximum power take up of the variable displacement pumps remains substantially constant over the entire operating region.

The spring arrangements associated with the power control valves of the known device consist in each case of a pressure spring, the setting value of which determines the backpressure and thus the maximum power take up of the respective variable displacement pump. The backpressure is chosen such that each variable displacement pump is set to 100% total drive power. This power can be transmitted by each variable displacement pump for as long as the pressure difference acting on the associated power control valve equals the set backpressure, i.e. there is no second control pressure, since the respective other variable displacement pump does not require any power.

With increasing power take up of the lastmentioned variable displacement pump, as a consequence of the appropriately rising second control pressure the pressure difference at the power control valve of the first variable displacement pump reduces and thus its power setting reduces.

However, as soon as both variable displacement pumps transmit in each case 50% of the total drive power, their power take up is restricted to this value. For this purpose an appropriate power restriction in the form of throttle and valve devices is provided, which prevents a reduction of the power setting of the respective other variable displacement pump. These devices are comparatively costly in terms of construction and are not a standard delivery component of the known device. They are installed subsequently by the customer during installation of the power control device and the variable displacement pumps in vehicles etc..

OBJECT OF THE INVENTION

The object of the invention is to develop a device of the type named at the beginning in such a way that it already includes the power restriction, in a design which is simplified in terms of construction, ex-factory as an integral component.

SUMMARY OF THE INVENTION

According to the present invention there is provided a device for the power control of at least two hydrostatic variable displacement pumps, driven by a common drive motor and delivering into respective operating lines, through the adjustment of their displacement in dependence upon the operating pressure in both operating lines by means in each case of an adjusting device which can be acted upon with an adjusting pressure and is prestressed in the direction of maximum displacement, having in each case a power control valve associated with each adjusting device, which valve is acted upon by a first control pressure, corresponding with the operating pressure in the operating line of the variable displacement pump to be adjusted by the adjusting device, against a pressure difference in the direction of a control position, in which the power control valve controls the adjusting pressure acting upon the adjusting device in the direction tending to reduce the displacement of the variable displacement pump along a hyperbolic control curve, whereby the pressure difference results from a backpressure of a spring arrangement counteracting the first control pressure and from a second control pressure corresponding with the operating pressure in the operating line of the respective other variable displacement pump, and with increasing second control pressure drops from a specified maximum value to a specified minimum value, wherein the spring arrangement is divided into a first and a second pressure spring, in that the first pressure spring is set to a force corresponding with the minimum value ($\Delta p_{min}$) of the pressure difference and the second pressure spring is set to a force corresponding with the difference ($\Delta p_{max} - \Delta p_{min}$) between the maximum value ($\Delta p_{max}$) and the minimum value ($\Delta p_{min}$) of the pressure difference, and in that the first pressure spring with its set force and the second pressure spring with a force decreasing with increasing second control pressure act upon the power control valve.

With respect to construction, the power restriction comprises the first pressure springs, the constructional outlay for which is negligible, since they are used for the power control valves, instead of the return springs usual in the prior art.

The function of the power restriction results from the setting values and the arrangement of the first and second pressure springs, preferably constructed so that they can be adjusted, in cooperation with the respective second control pressure. The backpressure determining the maximum power take up (100% of the total drive power) of each variable displacement pump is divided, in accordance with the invention, into a first backpressure, i.e. the setting value of the first pressure spring, and a second backpressure, i.e. the setting value of the second pressure spring. Accordingly, the pressure difference between the backpressure and the second control pressure is also divided into a first pressure difference and a second pressure difference. Since the second control pressure only acts against the second pressure spring, but not against the first, the first pressure difference remains unchanged and equal to the setting value of the first pressure spring. The second pressure difference, between the second control pressure and the second pressure spring, acting on the power control valve of each variable displacement pump changes in inverse proportion to the power take up of the respective other variable displacement pump and equals zero when this variable displacement pump receives the power corresponding with the setting value of the second pressure spring. In this case the first control pressure is only faced with the first pressure difference, i.e. the backpressure of the first pressure spring, so that the power take up of the variable displacement pump cannot exceed the value set by this backpressure, i.e. is restricted thereto. Both first pressure springs therefore determine the power settings to which both variable displacement pumps are restricted, when the difference between the maximum powers they take up is a minimum, for example equal to zero with a power restriction to 50% for each variable displacement pump.

In accordance with a development of the invention and to attain the hyperbolic control curve, in each case a two-armed pivoted lever with a first lever arm and a second lever arm is associated with each power control valve and abuts the side of the power control valve lying opposite the first pressure spring with the first lever arm, the second lever arm being arranged between a first and a second piston respectively abutting the second lever arm, the first piston being mounted in the adjusting piston of the adjusting device constructed as adjustment cylinder so as to be displaceable perpendicular to the direction of movement of the adjusting piston and so as to be acted upon by the first control pressure in the direction of the second lever arm, and the second piston being acted upon by the second pressure spring against the second control pressure in the direction of the second lever arm.

BRIEF DESCRIPTION OF THE DRAWING

In the following the invention is described in more detail with reference to a preferred exemplary embodiment with reference to the circuit diagram according to the single FIGURE.

DETAILED DESCRIPTION OF PREFERRED EMBODIMENT ACCORDING TO THE INVENTION

The FIGURE shows two hydrostatic variable displacement pumps 1 and 2, for example axial piston pumps in swash-plate type of construction, which are in mechanical drive connection by way of a driving gear, not shown, with a drive motor of constant drive speed, likewise not shown. In the following, the components and devices associated with the variable displacement pumps 1, 2 are characterized if required by the appendices .1 and .2 to the reference numbers. Each variable displacement pump 1, 2 is connected by way of a respective suction line 3 and a respective leakage-oil line 4 to a tank 5 and by way of a respective operating line 6.1 and 6.2 to one or more consumers, not shown.

There is associated with each variable displacement pump 1, 2 a respective adjusting device in the form of a hydraulic adjustment cylinder 7.1 and 7.2 for adjusting their displacements. In each adjustment cylinder 7 an adjusting piston 8 is displaceably arranged and is connected by way of a piston rod 9 to an adjusting part 10 coupled to the swash plate of the respective variable displacement pump 1 and 2. Each adjusting piston 8 bounds in the respective adjustment cylinder 7.1 and 7.2 with its (smaller) piston ring face a left cylinder area 11 and with its (larger) piston face a right cylinder area 12. A prestressing spring 13 in the left cylinder area 11 acts on the adjusting piston 8 in the direction tending to reduce the right cylinder area 12 and thus in the direction tending to swing-out the respective variable displacement pump 1 and 2 to greater displacement.

Each piston rod 9 comprises a piston-rod section of smaller diameter and a piston-rod section of larger diameter. The latter is marked with the reference number 14 and is moulded to the respective adjusting piston 8. Its end region which is connected to the piston-rod section of smaller diameter projects out of the respective adjustment cylinder 7.1 and 7.2 and is provided with a blind hole extending perpendicular to its direction of movement, in which blind hole a piston 15.1 and 15.2, hereinafter termed first piston, is displaceably mounted.

Each first piston 15.1, 15.2 can be acted upon by a control pressure corresponding with the operating pressure in the operating line 6.1 and 6.2 of the respective variable displacement pump 1 and 2, hereinafter termed first control pressure. For this purpose there is provided in each case a first control pressure line 16.1, 17.1 and 16.2, 17.2 consisting in each case of a first line section 16.1 and 16.2 and in each case a second line section 17.1 and 17.2. The first line section 16.1 and 16.2 connects the operating line 6.1 and 6.2 to the left cylinder area 11 of the respective adjustment cylinder 7.1 and 7.2. By way of the second line section 17.1 and 17.2 extending in the respective piston-rod section 14.1 and 14.2 the respective left cylinder area 11.1 and 11.2 is connected to the respective blind hole.

Each first line section 16.1, 16.2 supplies the operating pressure in the respective operating line 6.1 and 6.2 as adjusting pressure to the left cylinder area 11 of the respective adjustment cylinder 7.1 and 7.2 and thus serves as adjusting pressure line. The right cylinder areas 12 can likewise be loaded with the operating pressure as adjusting pressure by way of a connection in each case.

With each variable displacement pump 1, 2 there is associated in each case a power control valve 18.1 and 18.2 in the form of a throttling 3/2-way valve with in each case a slide valve 19 to control the adjusting pressure loading of the respective adjustment cylinder 7.1 and 7.2. Each power control valve 18.1, 18.2 is provided with a tank connection and in each case a connection to a third line section 20.1 and 20.2 and a fourth line section 21.1 and 21.2 which both serve as adjusting pressure lines. Each third line section 20 leads to the left cylinder area 11 and each fourth line section 21 to the adjusting pressure connection of the right cylinder area 12 of the respective adjustment cylinder 7.1 and 7.2.

The slide valve 19 of each power control valve 18.1 and 18.2 is loaded on the left side in the FIGURE by an adjustable first pressure spring 22 in the direction of the starting position shown, in which the tank connection is opened and the connection to the third line section 20 is closed.

On the side of each power control valve 18.1 and 18.2 lying opposite the first pressure spring 22 there is arranged in each case a two-armed pivoted lever, pivotal about a pivot bearing 32.1 and 32.2 in each case, with a first lever arm 23.1 and 23.2 and a second lever arm 24.1 and 24.2. The first lever arm 23 abuts the slide valve 19 of the respective power control valve 18.1 and 18.2. The second lever arm 24 is arranged between the first piston 15 and the piston rod 25 of a second piston 26, both of which abut it. The arrangement of the pistons 15, 26 with respect to the second lever arm 24 is therefore made such that the first control pressure acts against the pressure of the first and the second pressure spring 22 and 30. Each second piston 26.1, 26.2 is displaceably mounted in a cylinder 27.1 and 27.2 in each case and with its (smaller) piston ring face bounds a control area 28 and with its (larger) piston face a spring area 29 in which an adjustable second pressure spring 30 is arranged. The control areas 28.1, 28.2 of the cylinders 27.1 and 27.2 associated with the two variable displacement pumps 1, 2 are connected by way of a second control pressure line 31.2 and 31.1 in each case as it were crosswise to the operating line 6.2 and 6.1 of the respective other variable displacement pump 2 and 1. In this way the second piston 26.1 associated with the power control valve 18.1 of the variable displacement pump 1 can be loaded with the operating pressure in the operating line 6.2 of the variable displacement pump 2 as second control pressure. The same applies accordingly for the second piston 26.2.

In the following, the function of the device in accordance with the invention is described with reference to a power restriction of the variable displacement pumps 1, 2 in the ratio of 60/40. Accordingly, the pressure springs 22.1 and 30.2 are set at 60% and the pressure springs 22.2 and 30.1 are set at 40% of the total drive power made available by the drive motor, i.e. to a value corresponding with the quotient of 100% total drive power and max. displacement of the respective variable displacement pump. The power control valves 18.1, 18.2 are located in their starting position so that both variable displacement pumps 1, 2 are set to maximum displacement.

Both variable displacement pumps are driven by the drive motor with the same and constant speed. If, in this respect, the variable displacement pump 2 does not take up any power, for example, and accordingly the second control pressure has the value zero, the second pressure difference at the second piston 26.1 equals the setting value of the second pressure spring 30.1 so that the power control valve 18.1 and thus the variable displacement pump 1 is set at 100% power.

If the variable displacement pump 1 now takes up this set power and with appropriate load by means of the connected consumer exceeds the hydraulic force of the operating pressure in the operating line 6.1, acting by way of the first piston 15.1 and the pivoted lever 23.1, 24.1 on the power control valve 18.1, and thus the first control pressure exceeds the setting force of the two pressure springs 22.1 and 30.1, the slide valve 19.1 of the power control valve 18.1 is displaced to the left into the control position in which the two cylinder areas 11.1 and 12.1 of the adjustment cylinder 7.1 are connected to one another. The operating pressure in the operating line 6.1 now loads as adjusting pressure the larger piston face of the adjusting piston 8.1 and displaces it while swinging the variable displacement pump 1 back to the left until force equilibrium prevails on the power control valve 18.1. In this respect the lever length of the second lever arm 24.1 shortens so that the operating pressure in the operating line 6.1 can rise in the same ratio as the displacement of the variable displacement pump 1 reduces. The product of operating pressure and displacement is kept constant in this way, i.e. the variable displacement pump 1 is controlled along a hyperbolic characteristic curve.

With maximum power take up of the variable displacement pump 1 the operating pressure in the operating line 6.1 acts by way of the second control pressure line 31.1 as second control pressure on the second piston 26.2 and reduces the pressure difference acting against the first control pressure compared with the second pressure spring 30.2 to the value zero. The power control valve 18.2 and thus the variable displacement pump 2 is now set according to the setting value of the first pressure spring 22.2 to 40% of the total drive power.

If the variable displacement pump 2 now takes up this power of 40%, its displacement is reduced in the manner already described above with the aid of the variable displacement pump 1 and is controlled along a hyperbolic characteristic curve when the hydraulic force of the operating pressure in the operating line 6.2 with appropriate load by means of the connected consumer exceeds the setting force of the first pressure spring 22.2. At the same time the operating pressure in the operating line 6.2 acts by way of the second control pressure line 31.2 as second control pressure on the second piston 26.1 and reduces the pressure difference acting against the first control pressure compared with the second pressure spring 30.1 to the value zero. The power control valve 18.1 and thus the variable displacement pump 1 is now set according to the setting value of the first pressure spring 22.1 to 60% of the total drive power.

When both variable displacement pumps 1, 2 transmit these set power values of 60% and 40% of the total drive power, they are restricted to these values, since the power setting of each variable displacement pump is not reduced by the second control pressure corresponding with the power take up of the respective other variable displacement pump even with the exceeding of the setting value of the associated second pressure spring 30; in such a case the piston rod 25 of the second piston 26 loaded by the second control pressure namely rises from the second lever arm 24 so that the power setting of the respective variable displacement pump can no longer be influenced by the power take up of the respective other variable displacement pump.

A higher power take up by means of one of the two variable displacement pumps is only possible when the power take up of the respective other variable displacement pump falls below the setting value of the first pressure spring 22 associated therewith.

What is claimed is:

1. Device for the power control of at least two hydrostatic variable displacement pumps, driven by a common drive motor and delivering into respective operating lines, through the adjustment of their displacement in dependence upon the operating pressure in both operating lines by means in each case of an adjusting device which can be acted upon with an adjusting pressure and i.e. prestressed in the direction of maximum displacement, having in each case a power control valve associated with each adjusting device, which valve is acted upon by a first control pressure, corresponding with the operating pressure in the operating line of the variable displacement pump to be adjusted by the adjusting device, against a pressure difference in the direction of a control position, in which the power control valve controls the adjusting pressure acting upon the adjusting device in the direction tending to reduce the displacement of the variable displacement pump along a hyperbolic control curve, whereby the pressure difference results from a backpressure of a spring arrangement counteracting the first control pressure and from a second control pressure corresponding with the operating pressure in the operating line of the respective other variable displacement pump, and with increasing second control pressure drops from a specified maximum value to a specified minimum value, wherein the spring arrangement is divided into a first and a second pressure spring, in that the first pressure spring is set to a force corresponding with the minimum value ($\Delta p_{min}$) of the pressure difference and the second pressure spring is set to a force corresponding with the difference ($\Delta p_{max} - \Delta p_{min}$) between the maximum value ($\Delta p_{max}$) and the minimum value ($\Delta p_{min}$) of the pressure difference, and in that the first pressure spring with its set force and the second pressure spring with a force decreasing with increasing second control pressure act upon the power control valve.

2. Device according to claim 1, wherein the first and the second pressure spring are adjustable.

3. Device according to claim 1, wherein in each case a two-armed pivoted lever with a first lever arm and a second lever arm is associated with each power control valve and abuts the side of the power control valve lying opposite the first pressure spring with the first lever arm, and wherein the second lever arm is arranged between a first and a second piston each abutting the second lever arm, whereby the first piston is mounted in the adjusting piston of the adjusting device constructed as adjustment cylinder so as to be displaceable perpendicular to the direction of movement of the adjusting piston and is acted upon by the first control pressure in the direction of the second lever arm, and whereby the second piston is acted upon by the second pressure spring against the second control pressure in the direction of the second lever arm.

* * * * *